United States Patent [19]

Taplin

[11] 4,456,031

[45] Jun. 26, 1984

[54] ELECTRO-HYDRAULIC SERVO VALVE SYSTEM

[75] Inventor: Lael B. Taplin, Union Lake, Mich.

[73] Assignee: Vickers, Incorporated, Troy, Mich.

[21] Appl. No.: 374,012

[22] Filed: May 3, 1982

[51] Int. Cl.[3] ..... F15B 13/043

[52] U.S. Cl. ..... 137/625.62; 91/363 A; 137/625.64

[58] Field of Search ..... 91/363 A; 137/625.62, 137/625.64

[56] References Cited

U.S. PATENT DOCUMENTS

| | | | |
|---|---|---|---|
| 3,910,314 | 10/1975 | Nicholson | 137/625.62 |
| 4,150,686 | 4/1979 | El Sherif et al. | 137/625.64 X |
| 4,216,795 | 8/1980 | Cobb et al. | 137/625.64 X |

*Primary Examiner*—Gerald A. Michalsky

*Attorney, Agent, or Firm*—Barnes, Kisselle, Raisch, Choate, Whittemore & Hulbert

[57] ABSTRACT

An electro-hydraulic servo valve system comprising a two-stage spool type servo valve including a first stage comprising an electrical force motor and a second stage including a spool for controlling flow to an actuator. The force motor is operable upon receipt of a command electrical signal to move the spool. A first feedback is operable to cause the force motor to stop the movement of the spool. A second feedback is also operable to stop the movement of the spool at a predetermined position. The second feedback has a greater gain than said first feedback so that it normally dominates in the system. The second feedback comprises a pair of identical electrical sensors connected in parallel, and operable by movement of the spool. A comparator circuit compares the electrical signals from the sensors and is operable when the signals deviate from one another by a predetermined amount to disable the second feedback so that the first feedback will function permitting the electro-hydraulic servo valve system to operate without the second feedback.

10 Claims, 4 Drawing Figures

TO TORQUE MOTOR-12
FET-44
FET-58
FET-70
17a
40a
64
66
PEAK DETECTOR
N1
DIGITAL LOGIC CONTROLLER
N2
PEAK DETECTOR
60
52
11
40a
58
FET.
18
62
56
54
50
V2
V1
40a
48a
46
44
FET
70
FET.
FROM SOURCE 10
35
36
40a
19

ELECTRO-HYDRAULIC SERVO VALVE SYSTEM

This invention relates to power transmission and particularly to electro-hydraulic servo valve systems.

BACKGROUND AND SUMMARY OF THE INVENTION

In directional valves, it has been common to utilize a closed loop position control system wherein the directional valve includes a hydraulic piston that drives the load. The hydraulic piston is moved by a force motor which receives an electrical signal and applies hydraulic fluid to move the piston which, in turn, controls the flow to an actuator that moves the load. A feedback is provided to return the force motor to its original or null position thereby stopping the spool movement at the desired point determined by the size of the initial electrical command signal to the motor. One commonly utilized type of electrohydraulic servo valve is known as the flapper type servo valve such as shown in U.S. Pat. Nos. 3,023,782 and 3,228,423 wherein the force motor comprises a torque motor that moves a flapper that, in turn, controls the flow between opposed nozzles to move the spool. Feedback is achieved by mechanical linkage between the flapper and the spool.

It has also been known that control of the hysteresis inherent in the electrical motor of electro-hydraulic servo valves can be achieved by use of a feedback transducer such as a potentiometer, linear variable differential transformer or the like such as shown in U.S. Pat. Nos. 2,964,059, 3,464,318 and 3,646,762. However, in the case of failure or malfunction of the transducers, the entire electro-hydraulic valve system becomes inoperable.

Accordingly, among the objectives of the present invention are to provide an electro-hydraulic servo valve system which utilizes an electrical sensor to provide feedback signals wherein the system includes another feedback system and control means are provided so that when the electrical sensor fails or malfunctions, the feedback system including the sensor is disabled and another feedback system becomes operable.

In a preferred form, the electro-hydraulic servo valve system comprises a two-stage spool type valve including a first stage comprising an electrical force motor and a second stage including a spool for controlling flow to an actuator. The force motor is operable upon receipt of a command electrical signal to move the spool. The system includes a first feedback operable to cause the force motor to stop the movement of the spool and a second feedback operable to stop the movement of the spool at a predetermined position. The second feedback means has a greater gain than said first feedback so that the second feedback normally dominates in the system. The second feedback comprises a pair of identical electrical sensors connected in mechanical parallel, and means for comparing the electrical signals from the sensors and operable when the signals deviate from one another by a predetermined amount to disable the second feedback so that the first feedback will function permitting the electro-hydraulic servo valve system to operate without the second feedback.

DESCRIPTION

Figure 1:
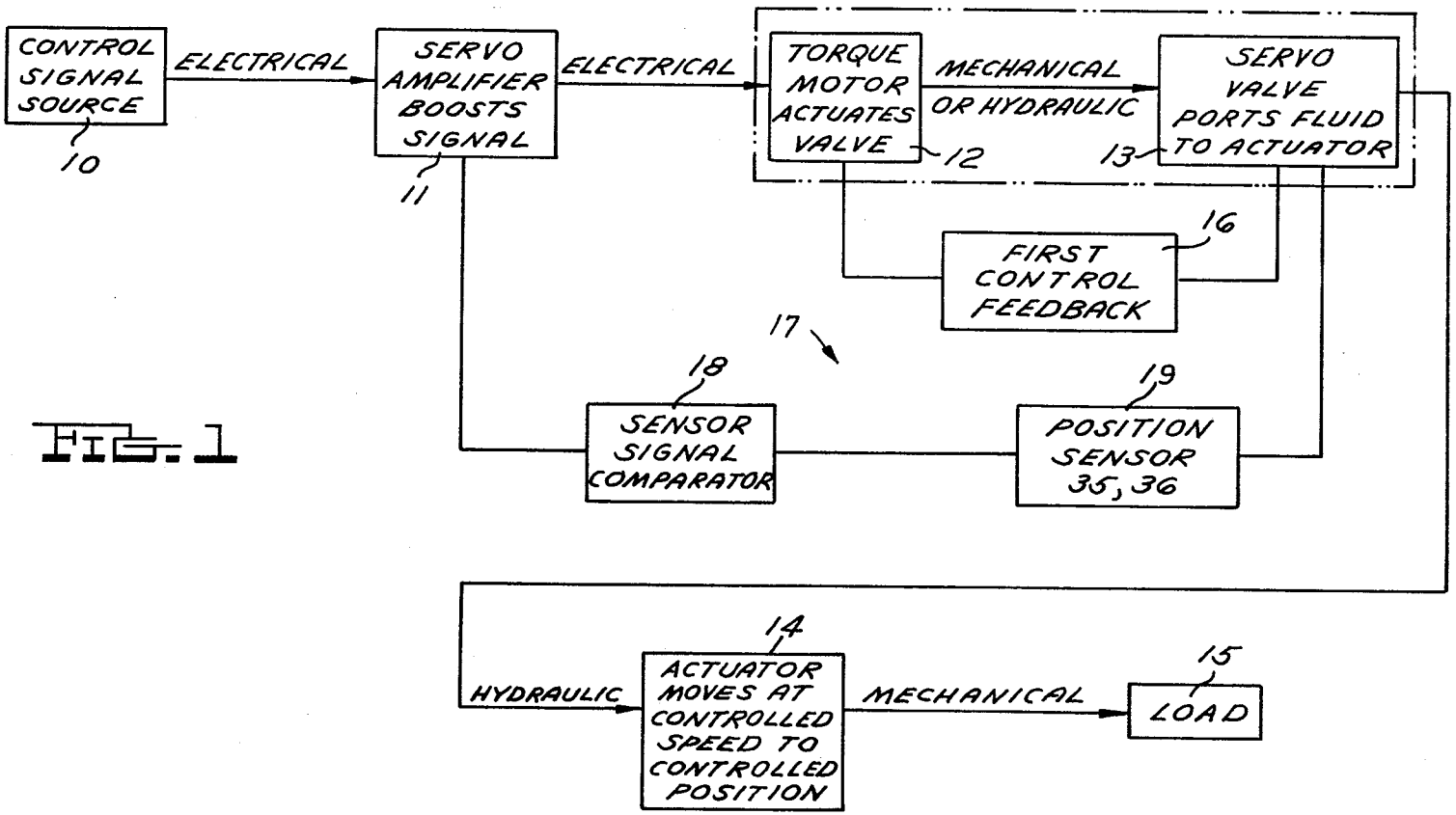
FIG. 1 is a block diagram of an electro-hydraulic servo valve system embodying the invention.

Referring to FIG. 1, which is a block diagram of the electro-hydraulic valve system embodying the invention, it can be seen that a command signal from a source 10 such as a potentiometer, a magnetic or punch tape, or other device, is provided to a servo amplifier 11 that boosts the signal and delivers it to a force motor 12 that actuates a servo valve 13. The servo valve 13 functions to supply hydraulic fluid to an actuator 14 that moves the load 15. The system includes a first feedback 16 associated with the position of the valve power stage spool and operates to return the torque motor to nearly its original position when the servo valve reaches a position corresponding to the desired command position. The system further includes a second feedback 17 comprising a pair of electrical sensors 19 that are associated with the position of the power stage spool. The second feedback 17 has a higher gain than the first feedback 16 so that it normally dominates. Further, a comparator system 18 functions to provide a dominant feedback signal to the amplifier 11 to return the torque motor 12 to its original position. In the event that the two sensors 19 associated with the second feedback 17 produce electrical signals that deviate from one another by a predetermined standard or amount, the comparator system 18 functions to disable the second feedback 17 permitting the first feedback 16 to control the electro-hydraulic valve system so that the system will still operate but without the benefit of the control of the hysteresis provided by the second feedback.

Figure 2:
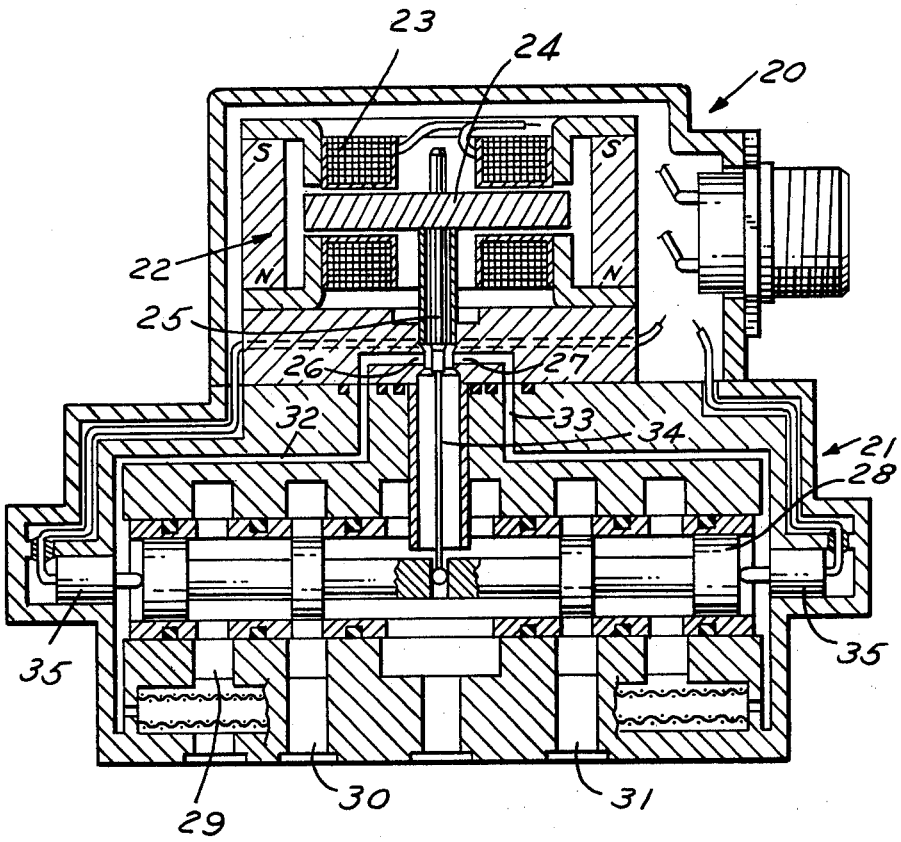
FIG. 2 is a sectional view of an electro-hydraulic valve utilized in the system.

Referring to FIG. 2, the electro-hydraulic servo valve utilized in the system preferably is of the two stage type comprising a first stage 20 and a second stage 21. The first stage 20 includes a torque motor 22 having windings 23 and an armature 24 that functions upon energization of the torque motor 22 to pivot a flapper 25 toward and away from nozzles 26,27 to apply fluid to the power or second stage 21. The second stage 21 includes a spool 28 that functions to supply pressure from an inlet 29 selectively to outlets 30,31. Fluid is supplied by the first stage to the opposed ends of the spool through lines 32,33. The first feedback comprises a mechanical feedback through a mechanical linkage provided by a spring 34 between the spool and flapper. Such an electro-hydraulic servo valve is shown in U.S. Pat. Nos. 3,023,782 and 3,228,423, which are incorporated herein by reference.

In accordance with one important aspect of the present invention, sensors 19 (FIG. 1) comprise a pair of identical sensors 35,36 positioned to sense the movement of the oppostie ends of the spool 28. Sensors 35,36 may comprise any suitable electrical transducers such as potentiometers, proximity transducers, linear variable differential transformers and the like. In second feedback 17 (FIG. 1), the position signals from sensors 35,36 are effectively compared in amplifier 11 with the command position signal from source 10, and the error in this comparison is amplified and used to supply current to the torque motor of the servo valve via a voltage to current amplifier stage. As previously indicated, the gain of the second feedback provided by the sensors 35,36 is greater than the first feedback 16, so that the second feedback normally dominates and controls the system. By using this feedback technique and setting the loop gain high, it is possible to virtually eliminate the effects of torque motor hysteresis and at the same time improve valve response. Specifically, using low cost linear potentiometers developed for automotive applications as sensors 35,36, a hysteresis of 0.3% has been achieved, which hysteresis is attributable to the sensors. Using precision proximity sensors, hysteresis is near zero. Attendant with the use of any spool position sensor 35 or 36, however, is the potential for failure of that sensor.

In accordance with another important aspect of the invention, an electronic controller including comparator 18 is provided to assess the condition of the sensors 35,36 and provide means for eliminating the feedback of the sensors in case of sensor failure. With the sensor failed, amplifier 11 operates in a second mode wherein the command signal from source 10 controls the torque motor directly via a controlled voltage-to-current amplifier stage and the same flow vs. command voltage is retained without the sensors present. The effect of hysteresis in the torque motor are now present, but the system is fail operative.

Figure 3:
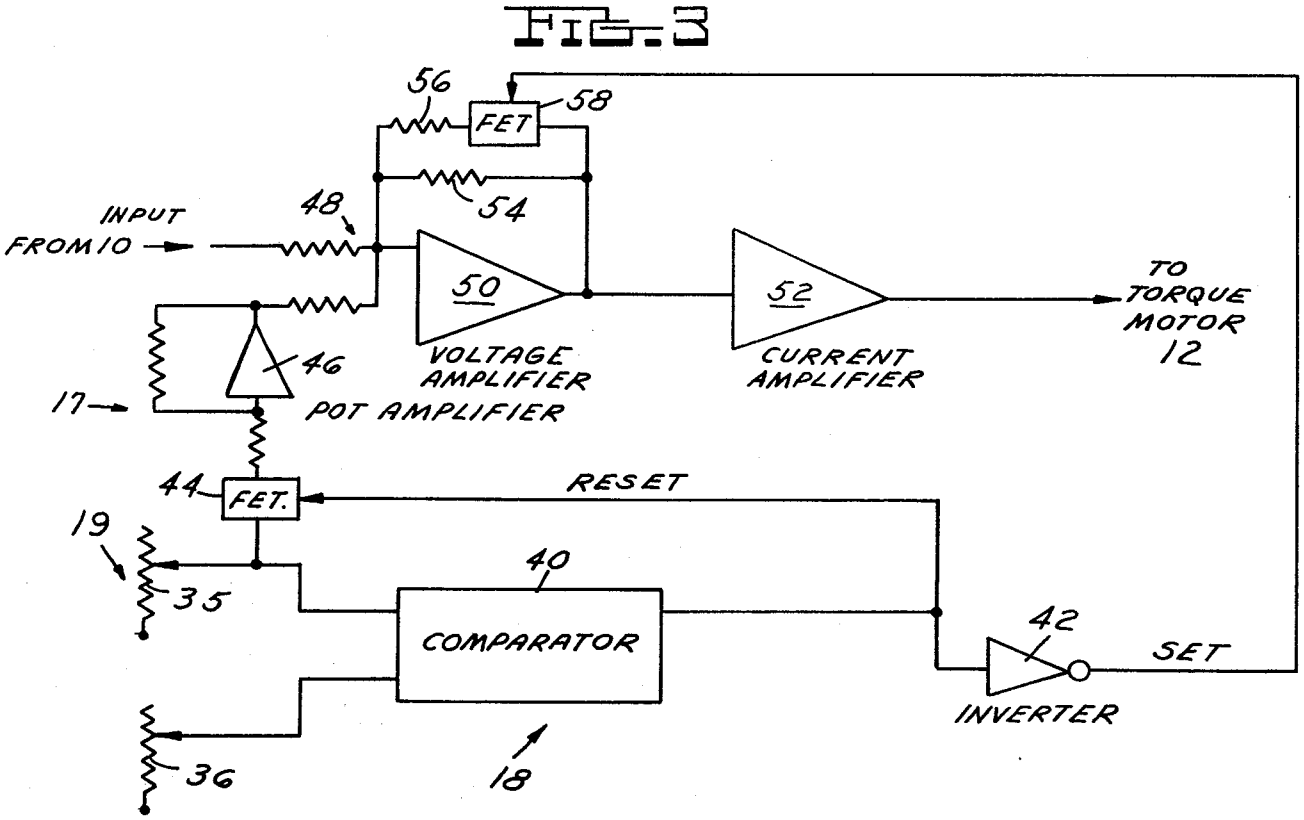
FIG. 3 is a partially functional and partially schematic electrical diagram of one presently preferred electronic controller in accordance with the invention.

FIG. 3 illustrates one embodiment of the electronic portion of the system of FIG. 1. Sensors 35,36 are connected to a voltage comparator 40, which has a RESET output fed to an inverter 42. An FET switch 44 is connected to feed the signal for sensor 35 through an amplifier 46 to a summing junction 48 under control of the RESET output of comparator 40. The command input signal from source 10 is also connected to summing junction 48 at the input of a voltage amplifier 50. The output of voltage amplifier 50 is fed through a current amplifier 52 to torque motor 12, amplifiers 50,52 thus constituting the voltage-to-current amplifier mentioned above. The gain of amplifier 52 is controlled by a pair of parallel feedback paths, one comprising a resistor 54, the other comprising a resistor 56 connected in series with an FET switch 58 which receives a control SET input from inverter 42.

In operation, as long as the signals from sensors 35,36 to comparator 40 remain identical, or substantially identical within the comparator deadband, the RESET signal to switch 44 remains on and the signal from sensor 35 is fed to summing junction 48. The sensor signal, indicative of actual position, is effectively substrated at junction 48 from the position command signal from source 10, and the difference or error signal is fed by voltage-to-current amplifiers 50,52 to torque motor 12. The SET output from inverter 42 remains off during this normal mode of operation, switch 58 is open and the gain of amplifier 50 is set by resistor 54. If the signals from sensors 35,36 differ from each other by more than the comparator deadband, indicating a sensor-failure mode of operation, the comparator RESET output turns off, and switch 44 opens. At the same time, the SET output from inverter 42 closes switch 58, and the gain of amplifier 50 is set by resistors 54,56 in parallel. The new amplifier gain is set such that the valve has the same flow gain as before, but hysteresis is now present. The system should, however, continue to operate because mechanical feedback exists internal to the valve.

Figure 4:
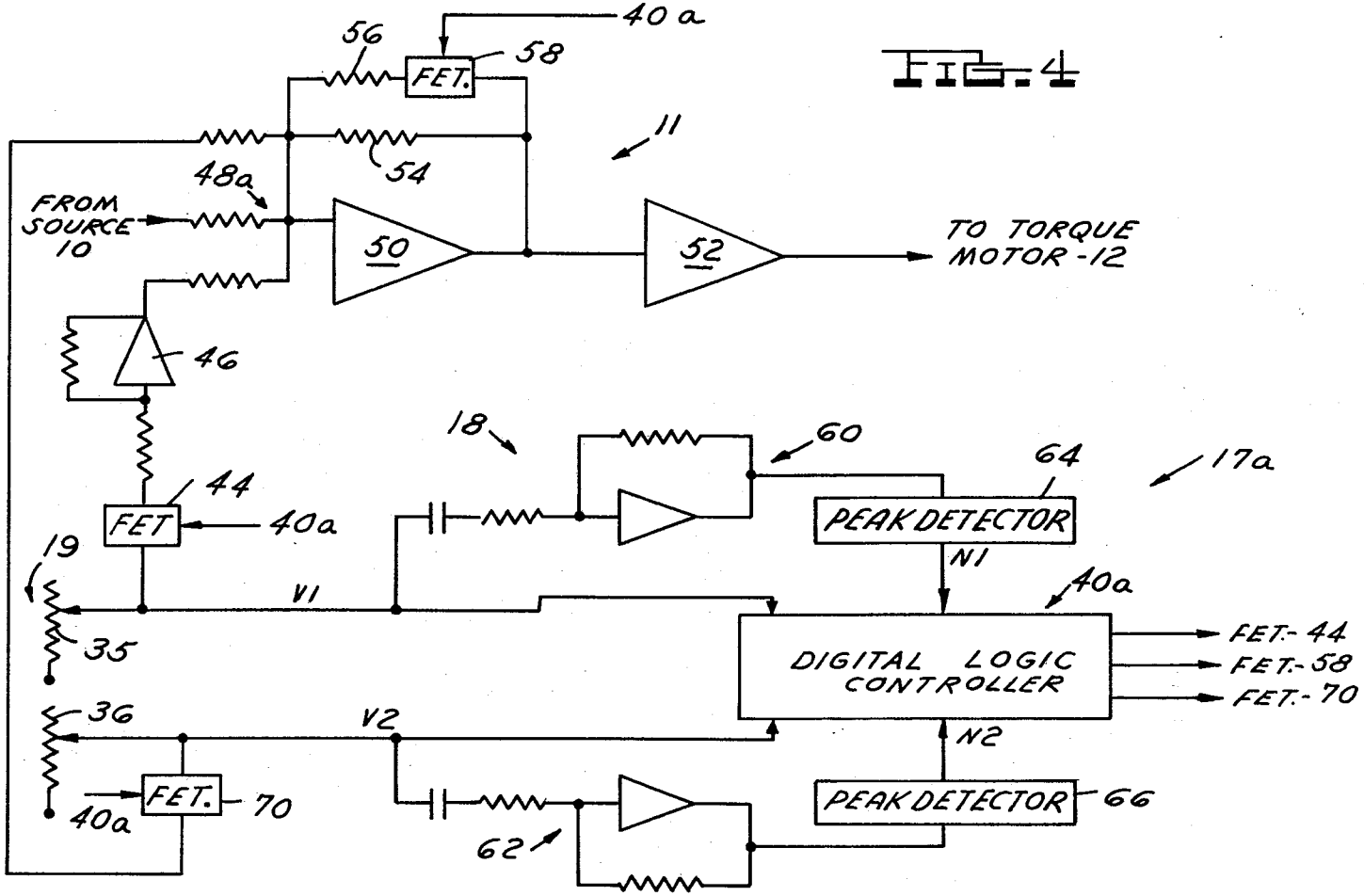
FIG. 4 is a partially functional and partially schematic electrical diagram of a modified electronic controller in accordance with the invention.

FIG. 4 illustrates a modification to the embodiment of FIG. 3. In FIG. 4, elements identical in structure and function to those illustrated and hereinabove described are identified by correspondingly identical reference numerals, and elements similar but modified in structure and function are identified by corresponding reference numerals followed by the suffix "a". Voltage signals V1,V2 from sensors 35,36 are fed to corresponding inputs of digital logic controller **40*a*, which may comprise discrete circuitry or a suitably programmed microprocessor. Sensor signals V1,V2 are also fed through corresponding differentiating amplifier circuits 60,62 to peak detectors 64,66. Detectors 64,66 provide signals N1,N2 to controller 40*a* as a function of maximum rate of change of signals V1,V2. Controller 40*a* provides control signals to FET switches 44,58 for purposes previously described. In the modification of FIG. 4, sensor 36 is also connected to summing junction 48*a* through an FET switch 70 which receives a control input from controller 40*a***.

Operation of the modified embodiment of FIG. 4 is summarized by the following table, wherein d is the V1,V2 deadband of controller **40*a*, dN is the N1,N2 deadband of controller 40*a***, +V is the positive supply voltage, "0" is zero volts, "on" indicates a conductive condition for the corresponding FET switch and "off" indicates a non-conductive condition:

TABLE I

| Signal Conditions | FET Switch Conditions | | |
|---|---|---|---|
| | FET 44 | FET 58 | FET 70 |
| $\lvert V1 - V2 \rvert < d$ | on | off | off |
| $V1 = 0$ or $V2 = +V$ | off | off | on |
| $V1 = +V$ or $V2 = 0$ | on | off | off |
| $V1 = V2 = 0$ or $V1 = V2 = +V$ | off | on | off |
| $\lvert V1 - V2 \rvert > d$, $\lvert N1 \rvert > dN$ and $\lvert N2 \rvert < dN$ | off | off | on |
| $\lvert V1 - V2 \rvert > d$, $\lvert N1 \rvert < dN$ and $\lvert N2 \rvert > dN$ | on | off | off |
| $\lvert V1 - V2 \rvert > d$, $\lvert N1 \rvert > dN$ and $\lvert N2 \rvert > dN$ | off | on | off |

It should be understood that many other tests and comparison can be contrived to further refine control of the FETS in FIG. 4.

The invention claimed is:

1. An electro-hydraulic servo valve system comprising a two-stage spool type servo valve including a first stage comprising an electrical force motor and a second stage including a spool for controlling flow to an actuator, said force motor being operable upon receipt of a command electrical signal to move the spool, first feedback means operable to cause the force motor to stop the movement of the spool at a predetermined position, second feedback means operable to stop the movement of the spool at a predetermined position, said second feedback means having a greater gain than said first feedback means so that said second feedback means normally dominates the system, said second feedback means comprising a pair of identical electrical sensors connected in parallel, and means for comparing the electrical signals from said sensors and operable when the signals deviate from one another by a predetermined amount to disable the second feedback means so that the first feedback means will function permitting the electro-hydraulic servo valve system to operate without the second feedback means.

2. The electro-hydraulic servo valve system set forth in claim 1 wherein said first feedback means is of the mechanical type operable between the force motor and the spool.

3. The electro-hydraulic servo valve system set forth in claim 1 wherein said first stage comprises a torque motor and has a flapper associated with the torque motor, opposed nozzles associated with the flapper such that when the flapper moves toward one or the other of the nozzles, the balance of flow is changed causing hydraulic pressure to increase at one end of the spool and decrease at the other, said first feedback means comprising a mechanical linkage between the spool and the flapper.

4. The electro-hydraulic servo valve system set forth in claim 1 wherein said last-mentioned means for comparing the electrical signals from the pair of sensors comprises a circuit including a comparator having a high output when the sensors have the same output and a low output when the sensors signals disagree, a first switch circuit operable by a high output to provide feedback, and a second switch circuit operable upon low output to disable the feedback.

5. The electro-hydraulic servo valve system set forth in claim 4 wherein said second switch circuit includes amplifier means.

6. The electro-hydraulic servo valve system set forth in claim 1 wherein said first feedback means comprises amplifier means adapted to receive a first signal indicative of said command signal and a second signal indicative of position of said spool, and to provide in a first mode of operation an output signal to said force motor indicative of a difference between said command and position signals, and first switch means adapted selectively to connect one of said sensor signals to said amplifier means to provide said position signal, and wherein said comparing means comprises means responsive to said sensor signals for providing a control signal to said switch means as a function of a predetermined relationship between said sensor signals.

7. The electro-hydraulic servo valve system set forth in claim 6 wherein said amplifier means further includes second switch means responsive to said comparing means in a second mode of operation to provide said output signal to said force motor as a function of said command signal and independently of said position signal.

8. The electro-hydraulic servo valve system set forth in claim 7 wherein said first switch means comprises first and second electronic switches for selectively connecting either of said sensor signals to said amplifier means, and wherein said comparing means comprises means for connecting one or the other but not both of said sensor signals to said amplifier means in said first mode of operation of said amplifier means and for disconnecting both of said sensor signals from said amplifier means in said second mode of operation.

9. The electro-hydraulic servo valve system set forth in claim 8 wherein said amplifier means includes an amplifier with said second switch means being connected in the gain circuit of said amplifier so as to provide differing gain characteristics at said amplifier in said first and second modes of operation.

10. The electro-hydraulic servo valve system set forth in claim 9 wherein said comparing means is conjointly responsive to amplitudes of said sensor signals and rate of change of said amplitudes.

* * * * *